US006168021B1

(12) United States Patent
Herbruck

(10) Patent No.: US 6,168,021 B1
(45) **Date of Patent: *Jan. 2, 2001**

(54) EGG CARTON HAVING COMPARTMENT FOR OTHER INGREDIENTS

(75) Inventor: Stephen H. Herbruck, Saranac, MI (US)

(73) Assignee: Herbruck's Poultry Ranch, Saranac, MI (US)

( * ) Notice: Under 35 U.S.C. 154(b), the term of this patent shall be extended for 0 days.

This patent is subject to a terminal disclaimer.

(21) Appl. No.: 09/322,598

(22) Filed: May 28, 1999

Related U.S. Application Data

(63) Continuation-in-part of application No. 09/008,384, filed on Jan. 16, 1998.

(51) Int. Cl.[7] ..... B65D 85/32

(52) U.S. Cl. ..... 206/541; 206/521.8; 426/120

(58) Field of Search ..... 206/521.1, 521.8, 206/521.9; 217/26.5; 229/406, 407; 426/120

(56) References Cited

U.S. PATENT DOCUMENTS

| | | | |
|---|---|---|---|
| D. 165,856 | 2/1952 | Mytinger | D58/13 |
| D. 262,355 | 12/1981 | Oakley | D9/345 |
| D. 306,263 | 2/1990 | Kerr et al. | D9/428 |
| D. 349,456 | 8/1994 | Wilson | D9/347 |
| D. 363,021 | 10/1995 | Lombard | D9/415 |
| 2,100,516 | 11/1937 | Read | 229/29 |
| 2,455,295 | 11/1948 | Cox | 229/29 |
| 2,600,130 | 6/1952 | Schilling | 229/2.5 |
| 2,655,303 | 10/1953 | Cox | 229/2.5 |
| 2,909,304 | 10/1959 | Powell | 222/130 |
| 3,131,846 | 5/1964 | Whiteford | 229/2.5 |
| 3,257,062 | 6/1966 | Whiteford | 229/2.5 |
| 3,421,682 | 1/1969 | Eisenbach | 229/51 |
| 3,484,035 | 12/1969 | Swett et al. | 229/15 |
| 3,531,044 | 9/1970 | Baker | 229/44 |
| 3,547,658 | 12/1970 | Melnick | 99/113 |
| 3,569,914 | 3/1971 | Ahlmeyer | 229/44 |
| 3,643,857 | 2/1972 | Noguchi | 229/44 R |
| 3,655,110 | 4/1972 | Eisenbach | 229/2.5 |
| 3,779,370 | 12/1973 | Snow et al. | 206/45.31 |
| 3,817,441 | 6/1974 | Jackson | 229/2.5 |
| 3,905,506 | 9/1975 | Florian | 220/23.8 |
| 4,314,650 | 2/1982 | Cillario | 220/23.83 |
| 4,348,421 | 9/1982 | Sakakibara et al. | 426/394 |
| 4,531,475 | 7/1985 | Thill | 118/503 |
| 4,656,042 | 4/1987 | Risler | 426/396 |
| 4,693,205 | 9/1987 | Thill | 118/13 |
| 4,798,133 | 1/1989 | Johnson | 99/440 |
| 4,842,143 | 6/1989 | McKee, Sr. et al. | 206/521.1 |
| 4,899,881 | 2/1990 | Girard et al. | 206/457 |
| 4,934,525 | 6/1990 | Robinson | 206/217 |
| 5,094,355 * | 3/1992 | Clark et al. | 229/406 |
| 5,277,920 | 1/1994 | Weaver, Jr. | 426/115 |
| 5,308,630 | 5/1994 | Nordahl | 426/270 |
| 5,312,634 | 5/1994 | Griesbach et al. | 426/106 |
| 5,316,173 * | 5/1994 | Emery | 229/407 |
| 5,674,546 | 10/1997 | Barnes et al. | 426/120 |
| 5,747,084 | 5/1998 | Cochran et al. | 426/120 |
| 5,807,597 | 9/1998 | Barnes et al. | 426/234 |

FOREIGN PATENT DOCUMENTS

| | | |
|---|---|---|
| 3324462 | 1/1985 | (DE) . |
| 2580602 | 10/1986 | (FR) . |
| 3512022 | 10/1986 | (DE) . |
| 2623781 | 6/1989 | (FR) . |

* cited by examiner

*Primary Examiner*—Jim Foster
(74) *Attorney, Agent, or Firm*—Price, Heneveld, Cooper, DeWitt & Litton

(57) ABSTRACT

An egg carton having a unique compartment or compartments for other ingredients or elements such as those for an omelette, other egg dishes, or for painting Easter eggs. The compartment or compartments accommodate sufficient ingredients for substantially all the eggs in the carton. In one embodiment, the compartments are located in each one half of the carton and the carton can be split.

38 Claims, 10 Drawing Sheets

EGG CARTON HAVING COMPARTMENT FOR OTHER INGREDIENTS

CROSS REFERENCE TO RELATED APPLICATION

The present application is a continuation-in-part of commonly owned U.S. patent application Ser. No. 09/008,384, filed Jan. 16, 1998, entitled "AN EGG CARTON HAVING COMPARTMENT FOR OTHER INGREDIENTS. "

FIELD OF THE INVENTION

This invention relates to an invention in which an egg carton is modified to provide one or more unique compartments for containing different types of ingredients to be sold and used with the eggs sold and contained within the carton.

BACKGROUND OF THE INVENTION

Although it has been conceived many years ago as disclosed in the French Patent 2,623,781 to package in a box containing egg dehydrated ingredients for egg dishes, no suitable egg carton has been conceived to market eggs along with other ingredients in a presentable way so as to make such concept practical and commercially feasible.

Also, no one to my knowledge has designed an egg carton in which a separate unique compartment is provided to be isolated from the cups which contain the eggs so as prevent ingredients within the compartments from spilling over into the egg cups.

In addition, no one has designed a carton in which the amount of ingredients is sufficient to make an egg dish, such as an omelette, with all of the eggs in the same carton. Furthermore, since selection of a product by the consumer is often dependent on physical appearance, it is necessary that the package be attractive in appearance and efficiently display the food contents therein. As a result, there has been a continuing need for a carton in which eggs and an adequate amount of ingredients for making an egg dish can be contained within the same egg carton.

SUMMARY OF THE INVENTION

It is the purpose of the present invention to provide a new and improved egg carton which is capable of containing a number of raw eggs and a sufficient amount of ingredients for the preparation of an egg dish such as an omelette, eggs benedict, and the like.

Within a broad aspect of this invention such a carton is constructed partially of a conventional bottom having a plurality of bottom cups or egg receptacles for receiving the eggs and providing along and located adjacent at least two of such cups at least one compartment providing a separate container occupying a space substantially equivalent to two of said cups for containing elements such as ingredients for the preparation of an egg dish.

In one embodiment of my invention, a group of eight bottom cups are arranged in two rows intermediate the ends of the carton and two compartments each occupy a space substantially equivalent to a group of two bottom cups provided at each end of the carton. Within a narrow aspect of such an egg carton with the compartments located at each end, the carton is shaped and is serrated intermediate the ends at the middle of the carton so that the carton can be split into two parts, each part containing four eggs and one of the compartments.

In another embodiment of my invention, my carton is provided with two groups of four cups in the bottom, one group at each end of the carton and the compartment occupying a space substantially equivalent to a group of four bottom cups is located in the middle of the carton between the two groups of four bottom cups.

Within a more narrower aspect of my invention, the top for of my carton has a plurality of top cups, each top cup vertically aligned with one of the bottom cups whereby the aligned top and bottom cups each encompass and support an egg. In this embodiment, a compartment or compartments are provided extending along and located adjacent at least two of two aligned egg cups in the top. This compartment or compartments correspond to the compartment or compartments in the bottom so that when the top is folded over the bottom, a compartment or compartments are formed isolated from the eggs.

In still another embodiment of this invention in which both the top and bottom include vertically aligned cups and a compartment or compartments as above described, a cover is provided to cover the top to provide rigidity to the carton and also a flat surface for a label.

It is preferred that in all of the embodiments of the invention that the bottom and top and cover are all constructed of a transparent plastic so as to display the eggs and other elements within the carton so as to provide a more presentable and marketable product.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
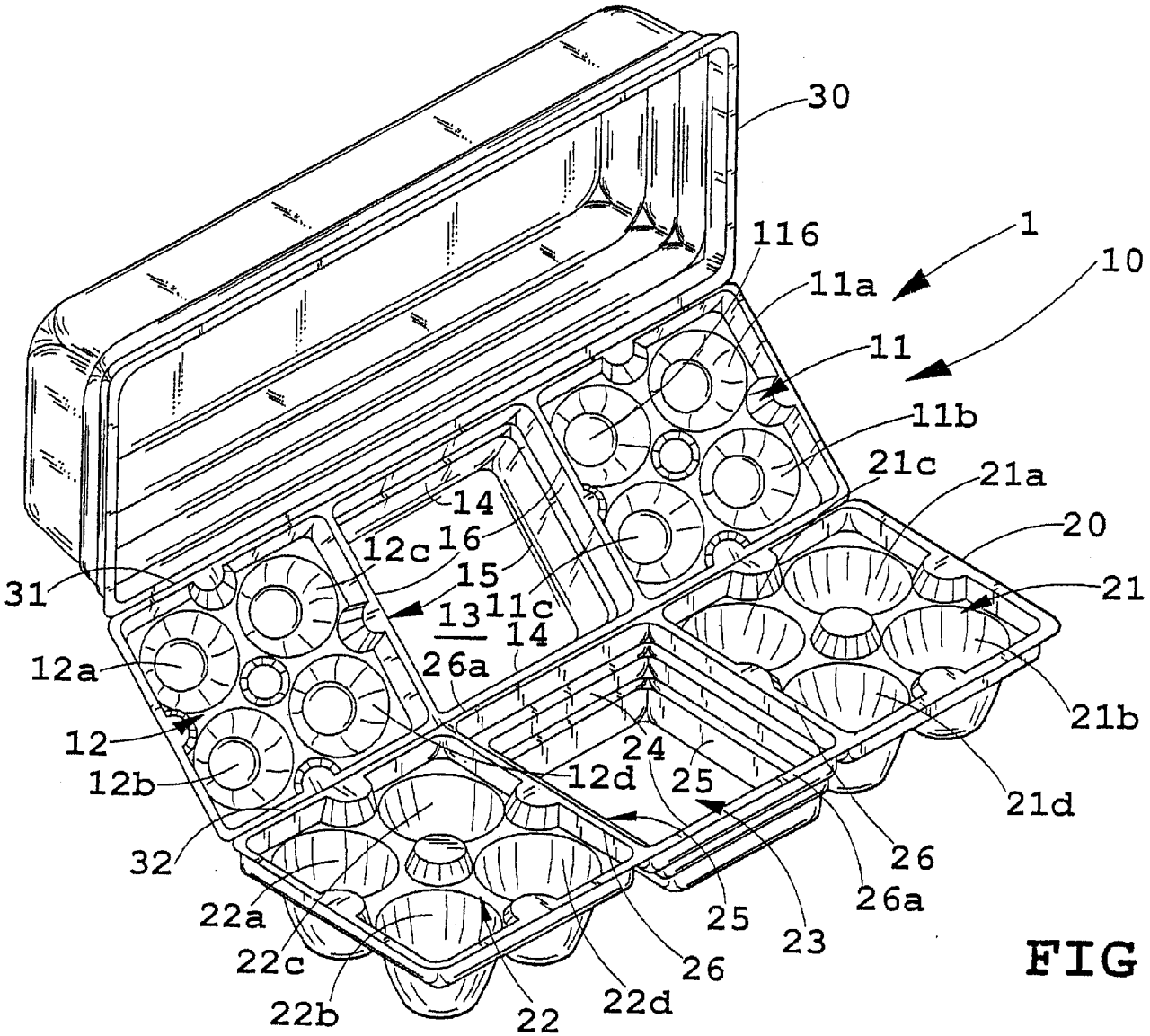
FIG. 1 is a perspective view of one embodiment of the carton of this invention.
Figure 2:
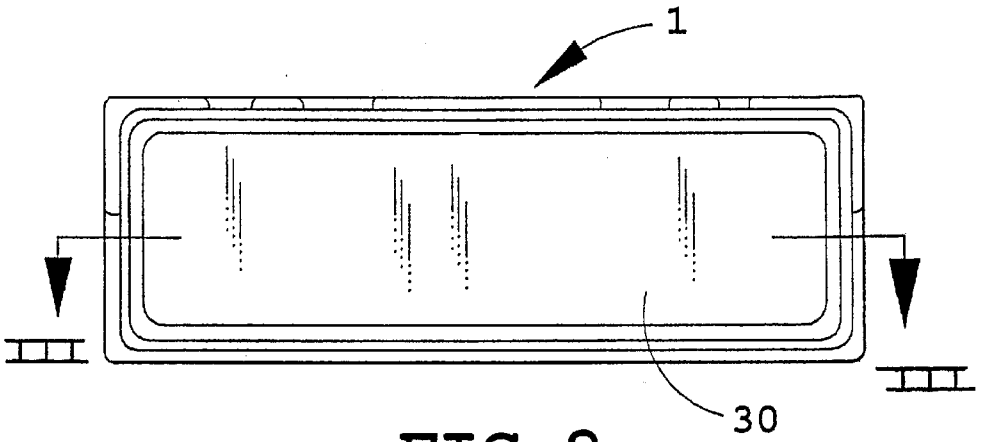
FIG. 2 is a top plan view of the embodiment of FIG. 1.

Referring to the drawings, FIG. 1 discloses a first embodiment of this invention in which reference numeral 1 designates the overall carton which comprises the three parts including the bottom 10, the top 20, and the cover 30.

Figure 5:
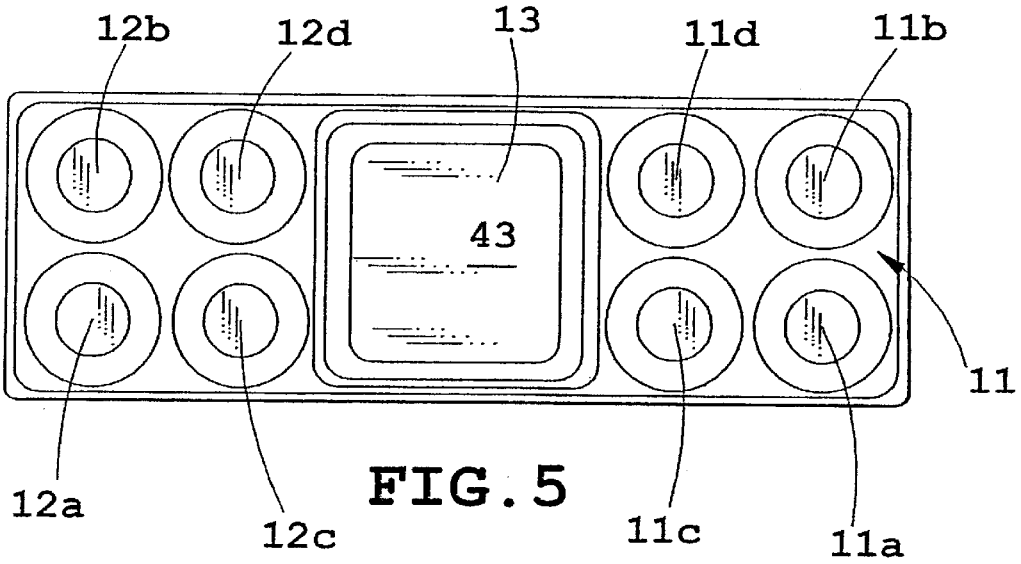
FIG. 5 is a bottom plan view of the embodiment of FIG. 1.

Bottom 10 includes a plurality of cup-like receptacles 11*a,* 11*b,* 11*c,* and 11*d* formed as a group of four receptacles or cups located at one end of the bottom 11. At the other end of the bottom is located the cup-like receptacles 12*a,* 12*b,* 12*c,* and 12*d* arranged in a group 12 substantially identical to the cups or cup-like receptacles 11*a*–11*d*. Intermediate the two groups of cups 11*a*–11*d* and 12*a*–12*d* is the compartment 13 which extends along two cups 11*c* and 11*d* and 12*c* and 12*d* and is substantially square in shape to occupy substantially the same area as each of the groups of cups 11*a*–11*d* and 12*a*–12*d*. The compartment 13 includes the sidewalls 14 and end walls 15 terminating at the top edges 14*a* and 15*a* (FIG. 5). The cups or cup-like receptacles 11*a*–11*d* and 12*a*–12*d* are of a shape as disclosed to accommodate the bottom of the eggs.

The bottom 20 includes at one end a group of cups or cup-like receptacles 21*a,* 21*b,* 21*c,* and 21*d*. At the other end of the bottom 20 are located the cups or cup-like receptacles 22*a,* 22*b,* 22*c,* and 22*d*. Between the two groups of cups 21*a*–21*d* and 22*a*–22*d* is provided a compartment 23 having the sidewalls 24 and the end walls 25 having the edges 25*a* and 26*a,* respectively.

Figure 7:
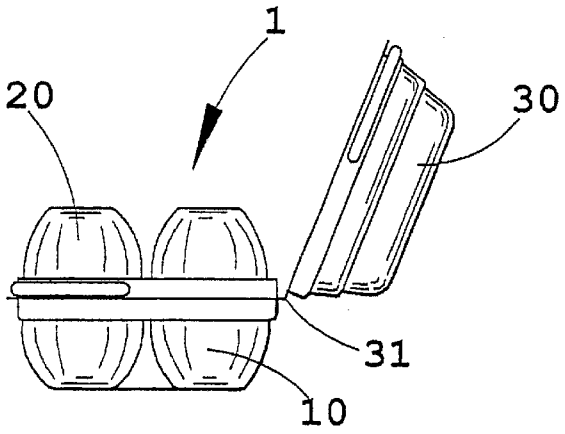
FIG. 7 is an end elevational view of the embodiment of FIG. 1 with the cover hinged upwardly.
Figure 4:
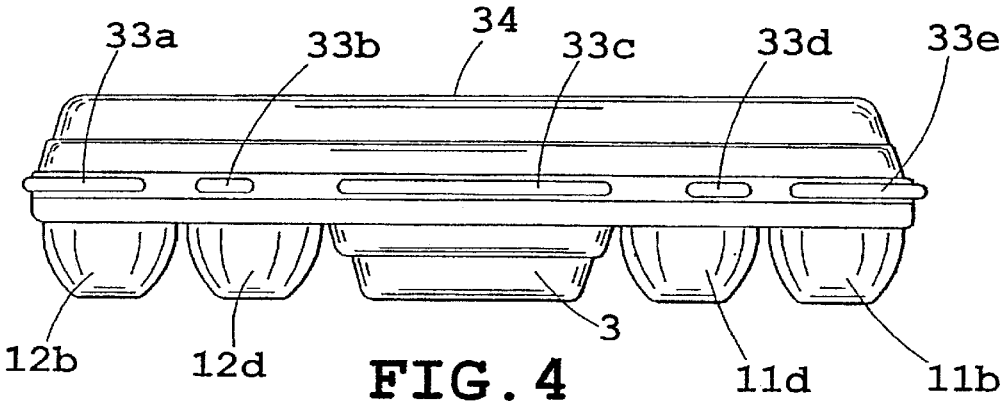
FIG. 4 is a side elevational view of the embodiment of FIG. 1.

The cover 30 conforms to the peripheral shapes of the bottom 10 and top 20. The cover 30 is hinged to one edge of the bottom 10 by a living hinge 31 whereas the top 20 is hinged to the bottom 10 by the living hinge 32. Thus, it should be readily apparent and as disclosed in FIGS. 7 and 8 that the top 20 is pivoted by living hinge 32 over the bottom 10 and the cover 30 is pivoted over the top 20 by living hinge 31 and is secured thereto by the locking elements 33*a,* 33*b,* 33*c,* 33*d,* and 33*e*.

It should be evident that when the top 20 is pivoted over the bottom 10, the group of cups 11*a*–11*d* are aligned with cups 21*a*–21*d,* respectively, and the group of cups 12*a*–12*d* are aligned with the group of cups 22*a*–22*d,* respectively. Further, the two compartments 13 and 23 are aligned and the edges 16 and 26 engage each other to form the overall compartment 43 (FIG. 3) so as to isolate compartment 43 from the eggs and prevent anything contained within such compartment from spilling over into the eggs, or any broken eggs spilling over into such compartment.

Figure 3:
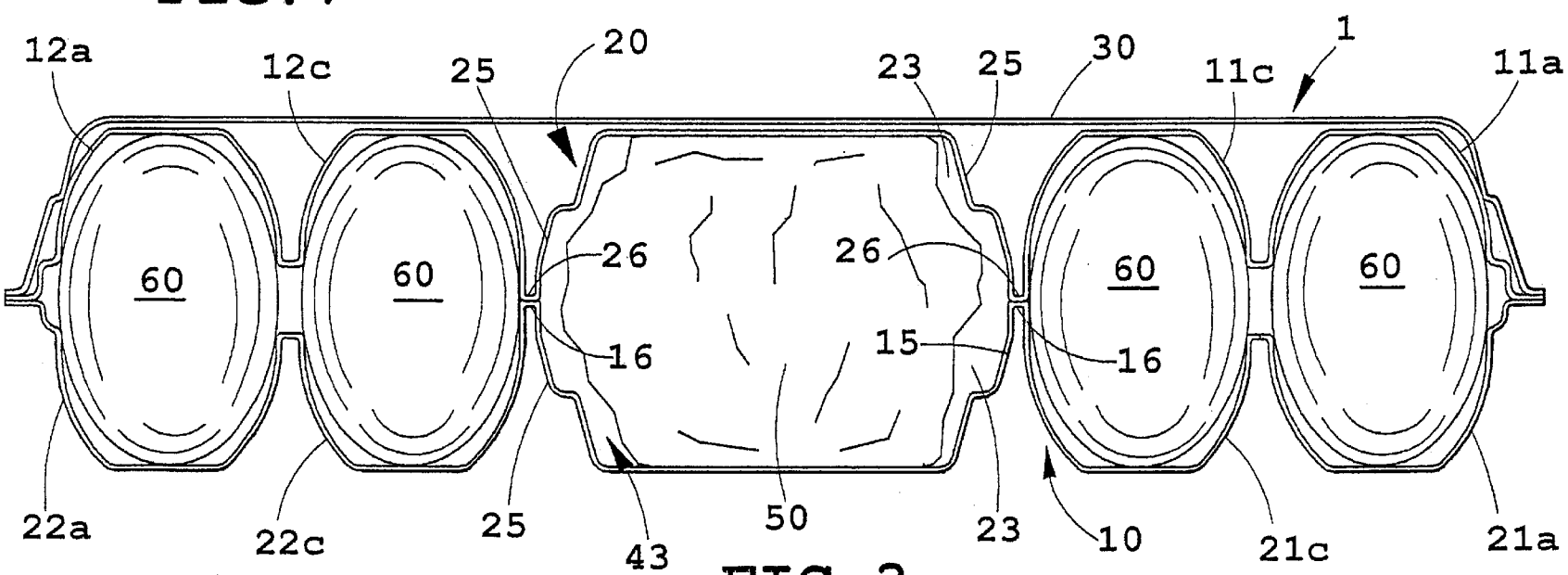
FIG. 3 is a cross section taken along the plane II—II of FIG. 2.

The cover 30 provides rigidity to the entire carton and also provides a flat surface 34 on which a label can be attached. The bottom 10, top 20, and cover 30 are all constructed of a transparent plastic of sufficient rigidity to support the eggs and give an integrity to the entire carton 1. As disclosed in FIG. 3, compartments 13 and 23 form the compartment 43 provided to accommodate various types of ingredients 50 for preparing an egg dish from the eggs 60 contained within the carton. This material may include cheese, meat, salsa, green pepper, onion, bacon chips, etc., for preparing an omelette. It also could contain the ingredients for other egg dishes such as egg benedict. Still another use of the compartment 43 could be the containment of necessary elements for the decoration of Easter eggs.

Figure 9:
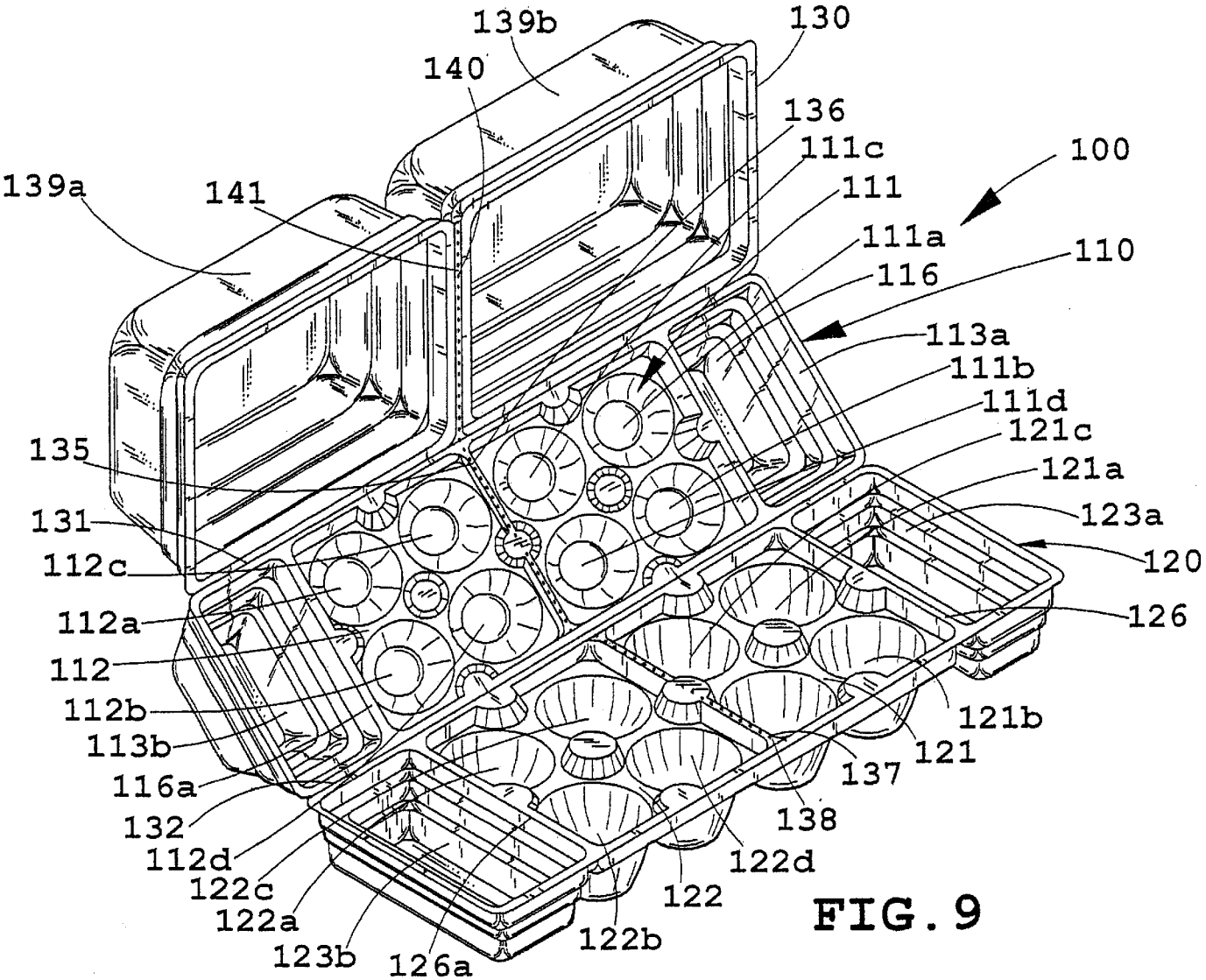
FIG. 9 is a perspective of a second embodiment of this invention.

FIG. 9 discloses a second embodiment of my invention in which reference numeral 100 designates the carton which includes the bottom 110, the top 120, and the cover 130. In this embodiment, compartments 113*a* and 113*b* are located at each end of the bottom and between these ends is located two groups 111 and 112 of cup or cup-like receptacles 111*a,* 111*b,* 111*c,* and 111*d* and 112*a,* 112*b,* 112*c,* and 112*d*. The two groups 111*a*–111*d* and 112*a*–112*d* are separated by a partition 135 which is serrated by serrations 136 for the purposes as will be described hereinafter.

The top 120 is similarly provided at one end with a compartment 123*a* and at the other end with the compartment 123*b*. Intermediate these two compartments are located the groups 121 of cups or cup-like receptacles 121*a,* 121*b,* 121*c,* and 121*d* and the group 122 of cups or cup-like receptacles 122*a,* 122*b,* 122*c,* and 122*d*. The groups 121 and 122 of cups 121*a*–121*d* and 122*a*–122*d* are separated by a partition 136 which is serrated by the serration 138.

Figure 11:
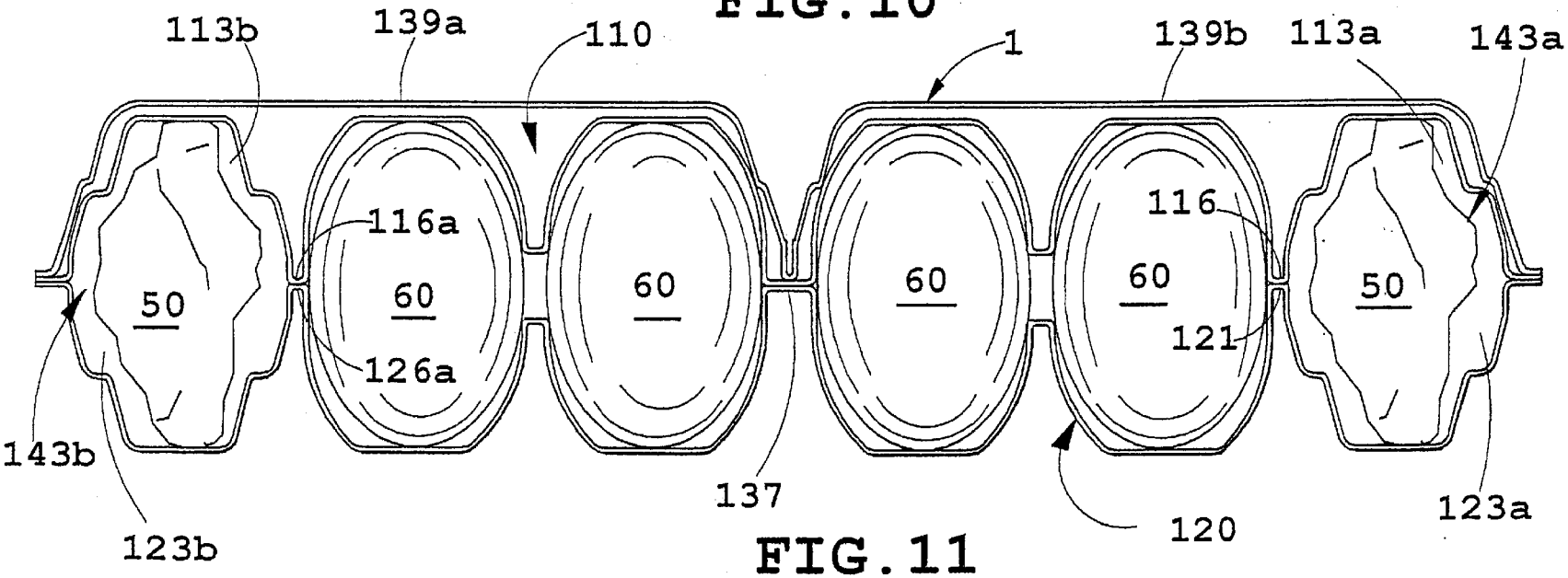
FIG. 11 is a cross-sectional view taken along the plane XI—XI of FIG. 10.

As is evident from FIG. 11 and apparent from FIG. 9, the compartments 113*a* and 123*a* and compartments 113*b* and 123*b* are aligned to form the compartments 113 and 123, respectively. Also, edges 116 and 126 engage each other and the edges 116*a* and 126*a* engage each other so as to isolate the compartments 143*a* and 143*b* formed by 113*a,* 113*b,* 123*a,* and 123*b,* respectively, from the eggs. It should also be evident that the cups 111*a*–111*d* and 121*a*–121*d* are vertically aligned as are cups 112*a*–112*d* and 122*a*–122*d*.

The top 130 is slightly different than top 30 of the first embodiment. It is divided into two parts 138 and 139 divided by the partition 140 which is serrated by the serration 141. The purpose of the partitions 135, 137, and 140 and the serrations 136, 138, and 141 is to provide a carton which can be split into two parts so that purchasers can purchase eight eggs with sufficient volume of ingredients for such eggs or four eggs with sufficient volume of ingredients for four eggs. As in the first embodiment, the top 120 is pivoted to one edge of bottom 110 by a living hinge 132 whereas the cover 130 is pivoted to the other edge of the bottom 110 by the living hinge 131.

Figure 8:
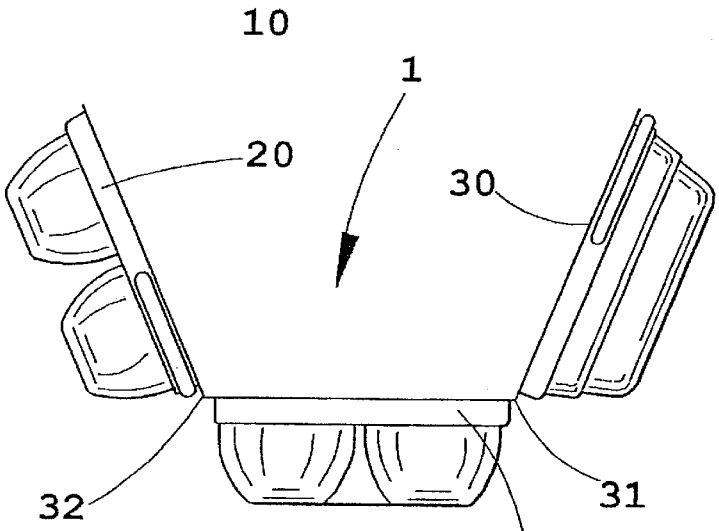
FIG. 8 is a side elevational view of the embodiment of FIG. 1 with the top and the cover both hinged upwardly into open position.
Figure 6:
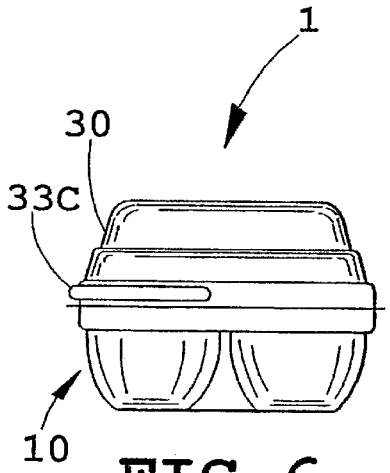
FIG. 6 is an end elevational view of the embodiment of FIG. 1.
Figure 10:
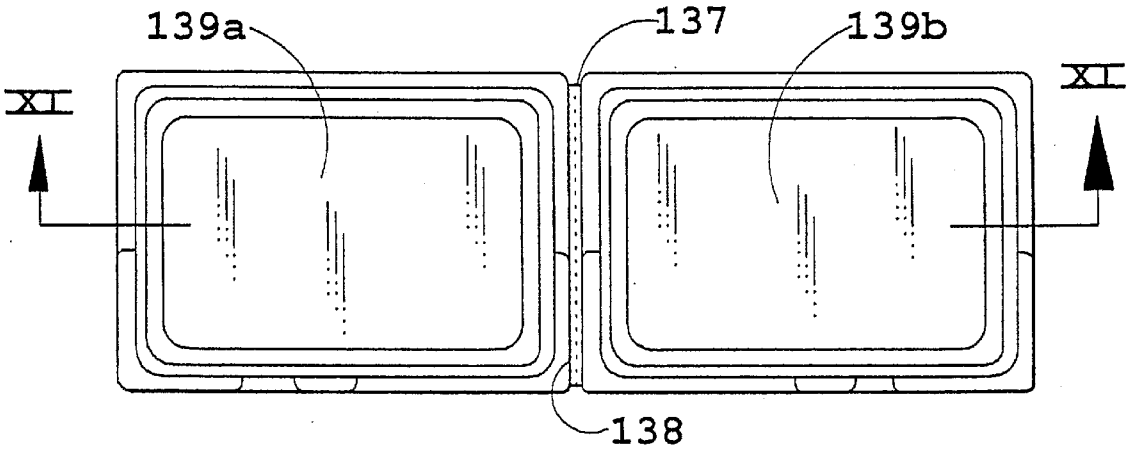
FIG. 10 is a top plan view of the embodiment of FIG. 9.

It should be evident from FIGS. 9, 10, and 11 that the top 120 is pivoted over the bottom 110 and the cover 130 is pivoted over the top 120 in a manner similar to that disclosed in FIG. 8. However, in this embodiment the entire carton 100 can be purchased or one half of the carton can be purchased.

Figure 12:
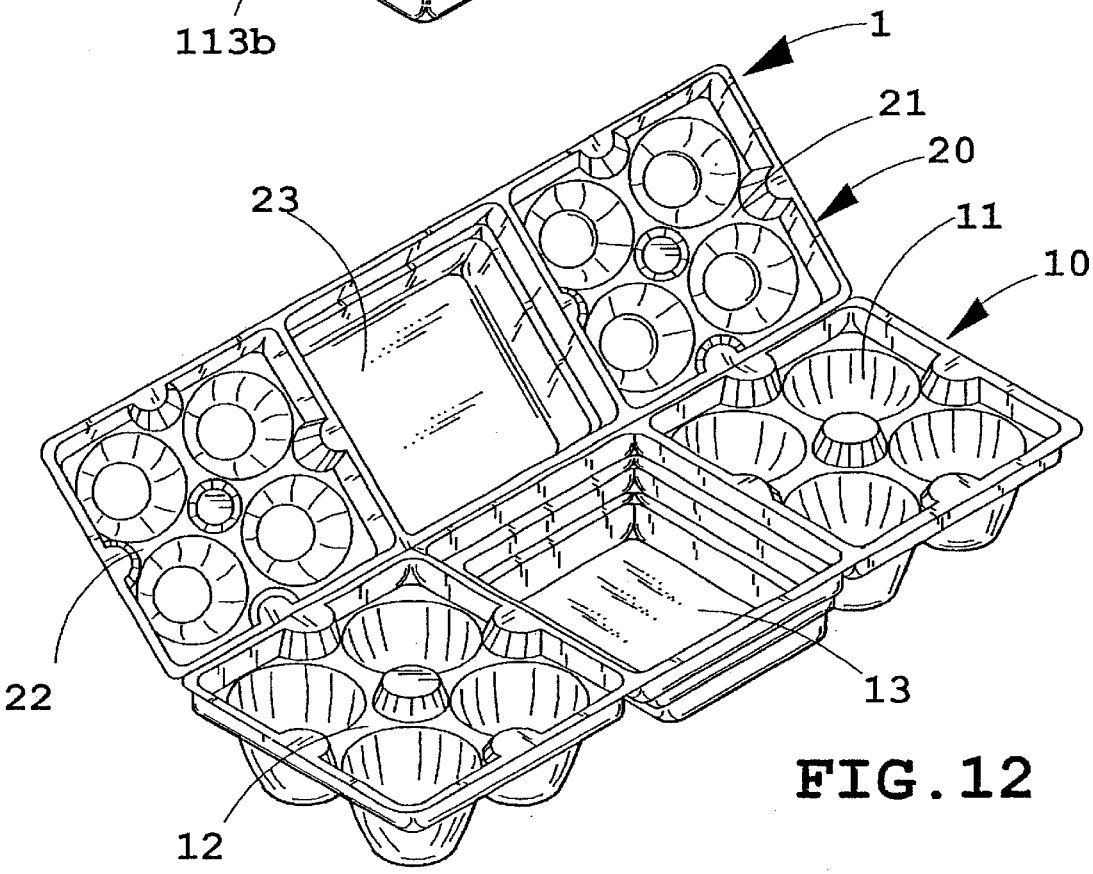
FIG. 12 is a perspective view of a third embodiment of this invention.

FIG. 12 shows still another embodiment of my invention in which the cover 30 of FIG. 1 has been deleted. Otherwise, the same elements of the bottom 10 and the top 20 are identical except for providing locking elements for locking the two parts together along their free edges.

Figure 13:
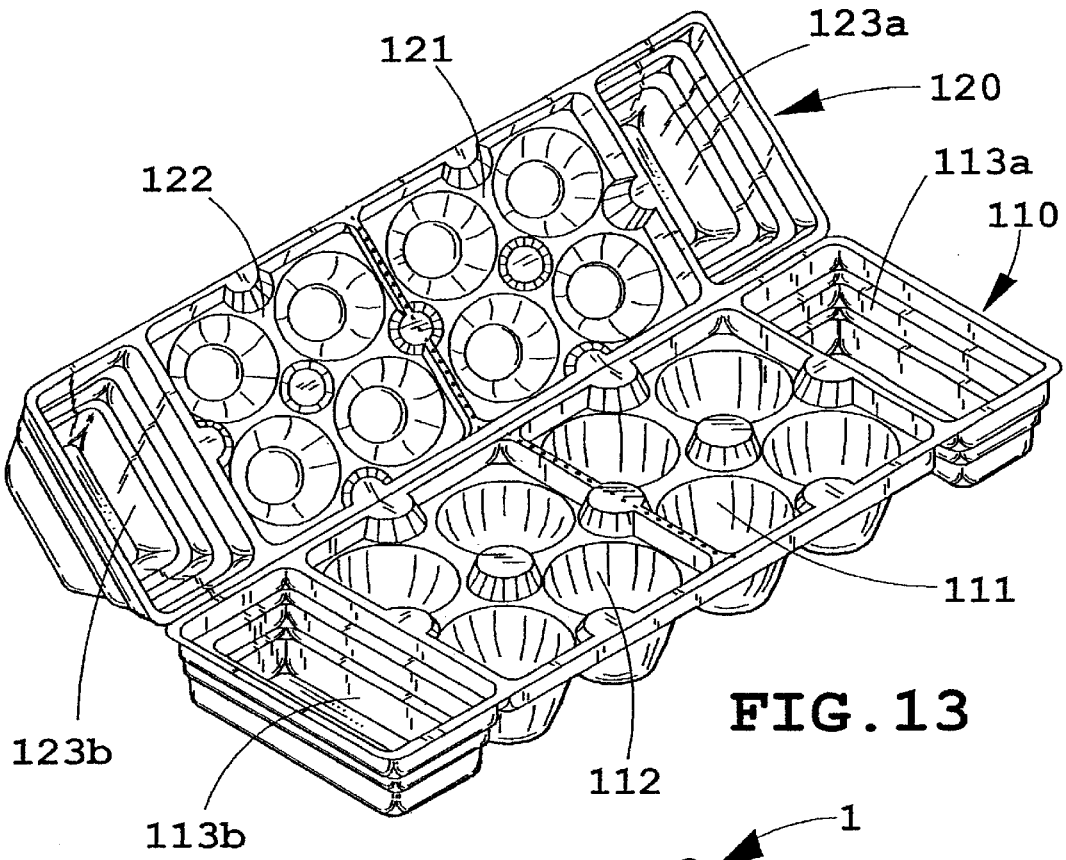
FIG. 13 is a perspective view of a fourth embodiment of this invention.

Another embodiment of my invention is disclosed in FIG. 13 in which the top 130 of FIG. 9 has been deleted. Otherwise, the bottom 110 and top 120 are identical except for providing a locking mechanism along the free edges of the top and bottom.

Figure 14:
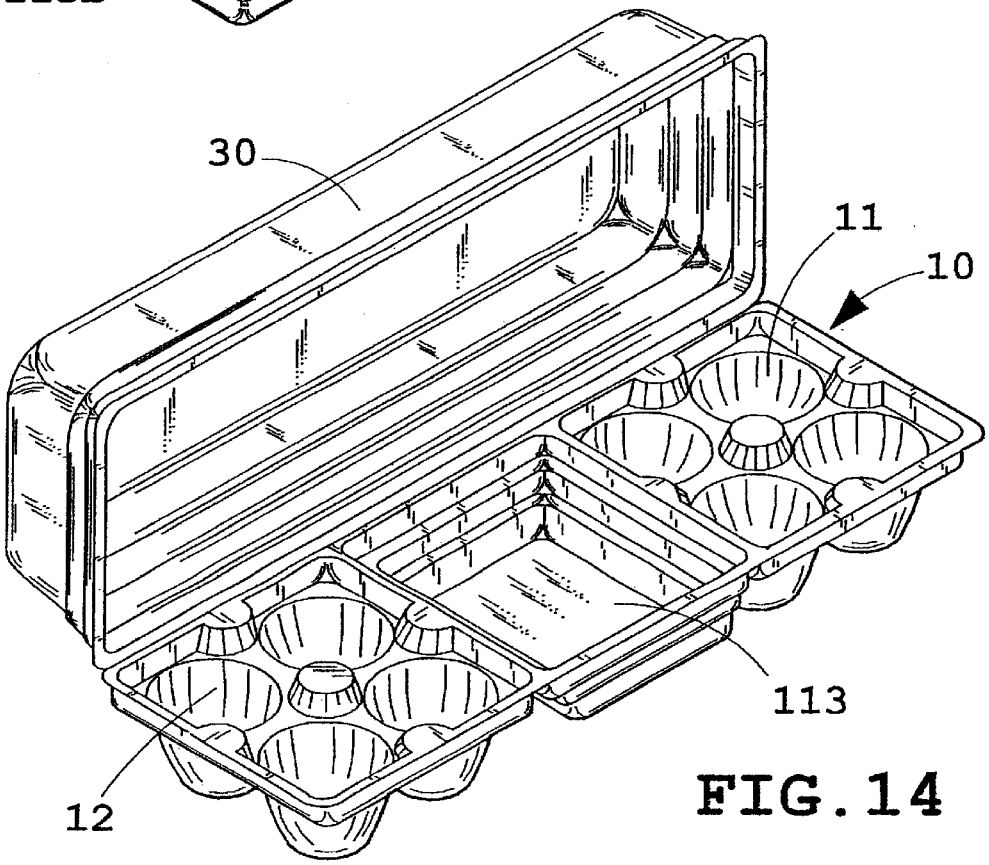
FIG. 14 is a perspective view of a fifth embodiment of this invention.

A fifth embodiment of my invention is disclosed in FIG. 14 wherein the top 20 of the embodiment of FIG. 1 is deleted. In this embodiment, the cover 30 provides the entire top for the eggs so that the top end of the eggs resting within the cups are not held as securely within the cups of the bottom. In other words, the entire eggs are not encapsulated as in the embodiment of FIG. 1. Also in this embodiment, the complete isolation of compartment 23 is not provided.

Figure 15:
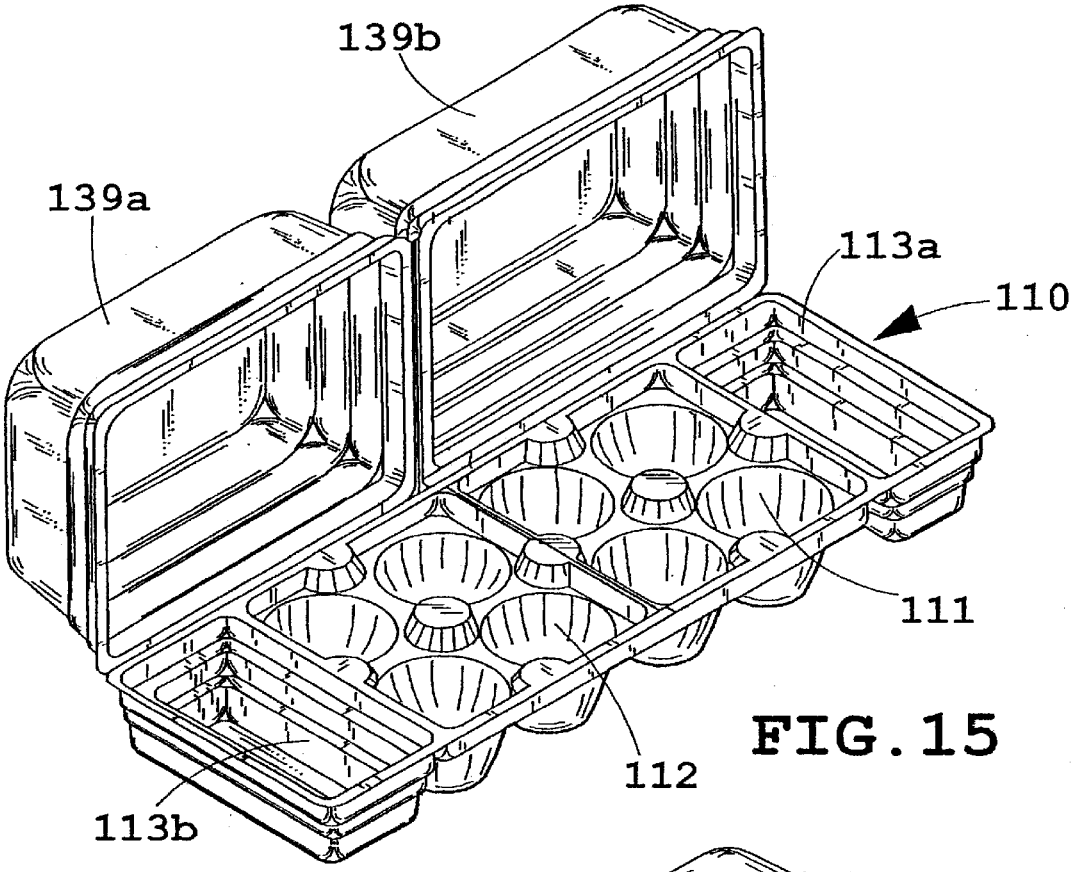
FIG. 15 is a perspective view of a sixth embodiment of this invention.

FIG. 15 discloses still another embodiment of my invention in which the top cupped part 120 is deleted similarly to that disclosed in FIG. 14. In other words, the two part cover 139*a* and 139*b* provides the only top for the carton thus eliminating the encapsulation of the entire bottom and top of the eggs. Also in this embodiment, the complete isolation of the compartments 113*a* and 113*b* is not provided.

Figure 16:
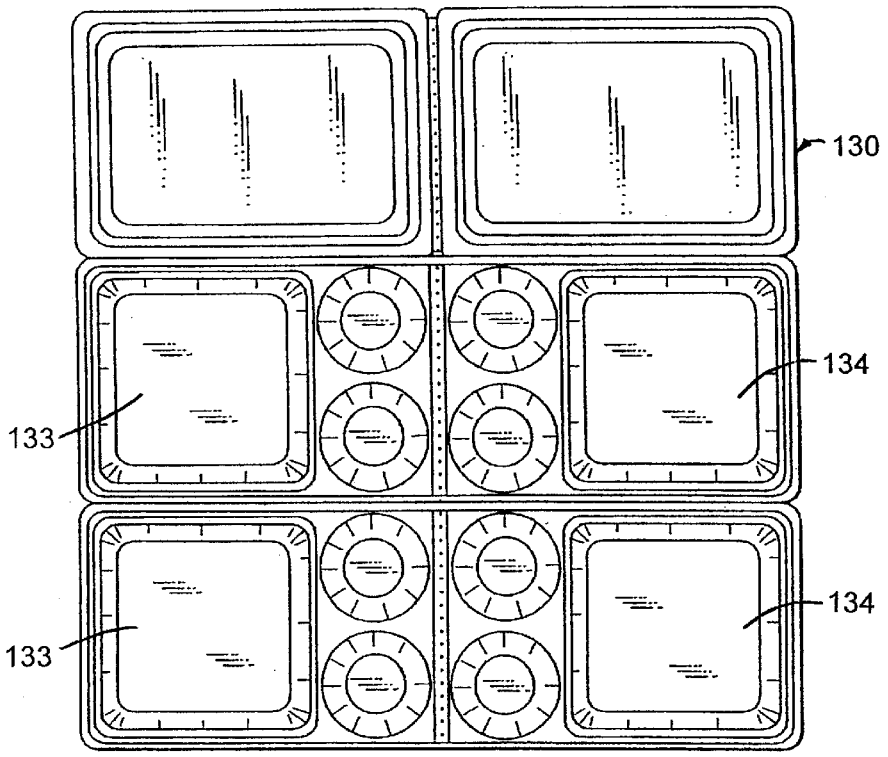
FIGS. 16–20 are plan views of additional embodiments of my invention.

FIG. 16 discloses an embodiment of my invention showing an arrangement in which compartments 133 and 134 occupy a space equivalent to four egg cups. This arrangement of the cups and compartments can be utilized with two covers as in FIGS. 1–8 or 9–11 or only one cover as in FIGS. 12 or 13 or one cover as in FIGS. 14 or 15. It should be understood that as disclosed with the two covers, the one cover that fits directly over the bottom would include egg cups and compartments as arranged in the bottom.

Figure 17:
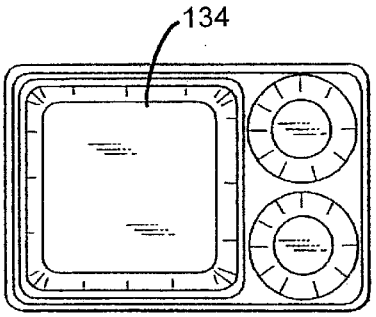

FIG. 17 discloses one half of the egg carton of FIG. 16.

Figure 18:
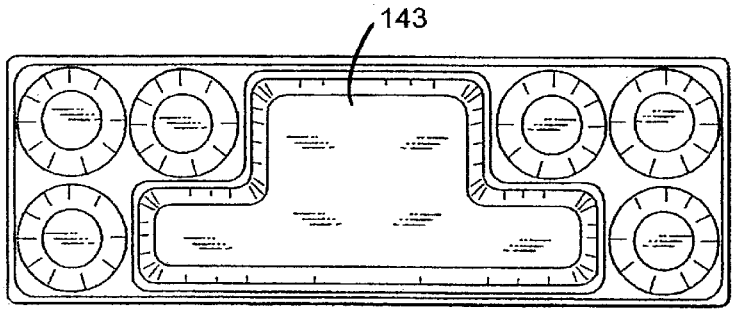

FIG. 18 shows still another arrangement for the egg cups and the compartment 143. This arrangement can also be utilized with one cover or two covers in the same way as disclosed in relation to FIG. 16.

Figure 19:
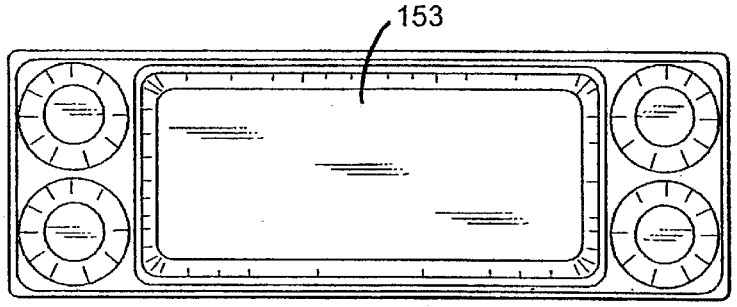

FIG. 19 shows still another arrangement for the egg cups and compartment 153 and can be utilized with one or two covers in the same way as disclosed in relation to FIG. 16.

Figure 20:
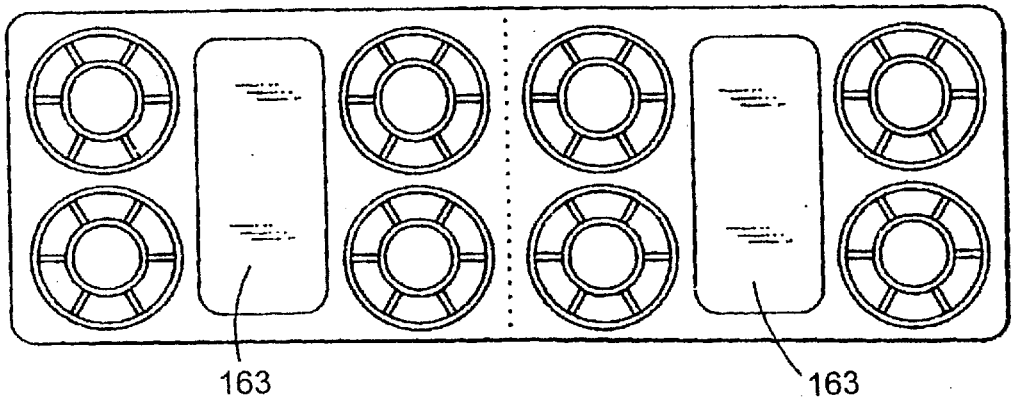

FIG. 20 is another arrangement for the egg cups and compartment 163 which also could be utilized with one or two covers as disclosed in relation to FIG. 16.

Figure 21:
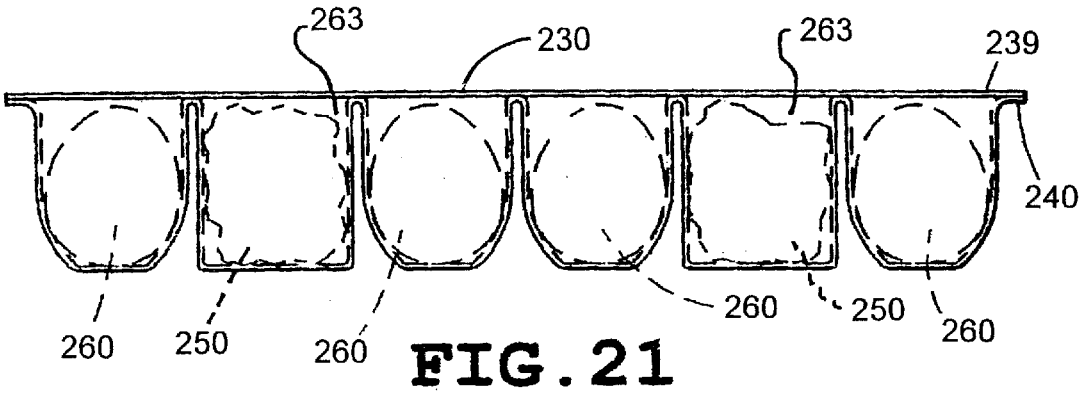
FIG. 21 is a cross-sectional side elevational view of still another embodiment of my invention.
Figure 22:
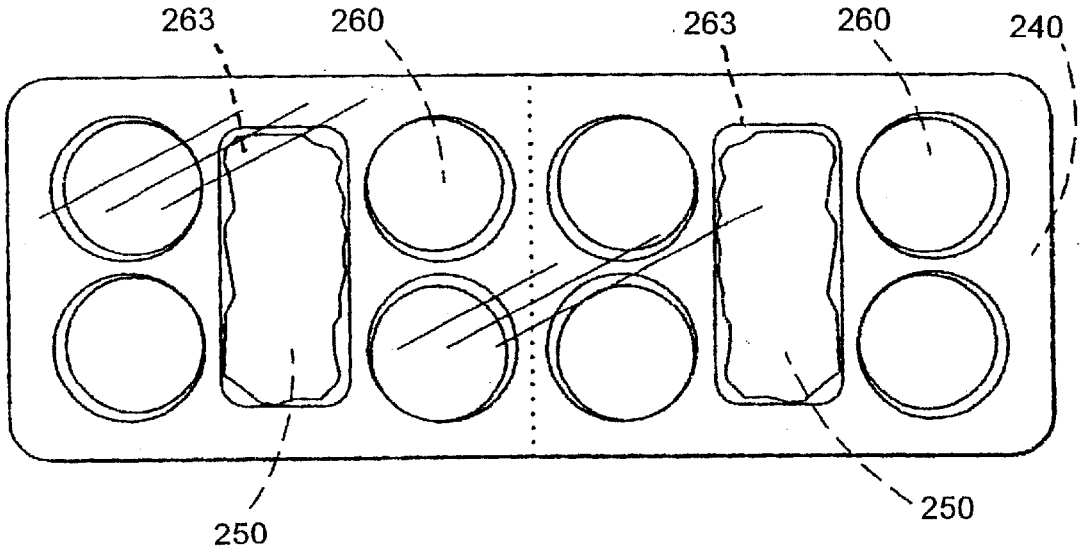
FIG. 22 is a plan view of the embodiment of FIG. 21.

FIGS. 21 and 22 disclose another embodiment of my invention in which the carton 230 is sufficiently deep to contain the eggs 260 below the plane of top edges of the carton and the top 239 is a sheet of material such as a transparent plastic adhered to the peripheral ledge 240 or applied by shrink-wrapping. In this embodiment the arrangement of the eggs 260 and compartments 263 is as disclosed in FIG. 20 but could be any of the other arrangements as disclosed in FIGS. 1–19. As disclosed in FIGS. 21 and 22, the compartments 263 contain the elements 250 other than eggs.

Figure 23:
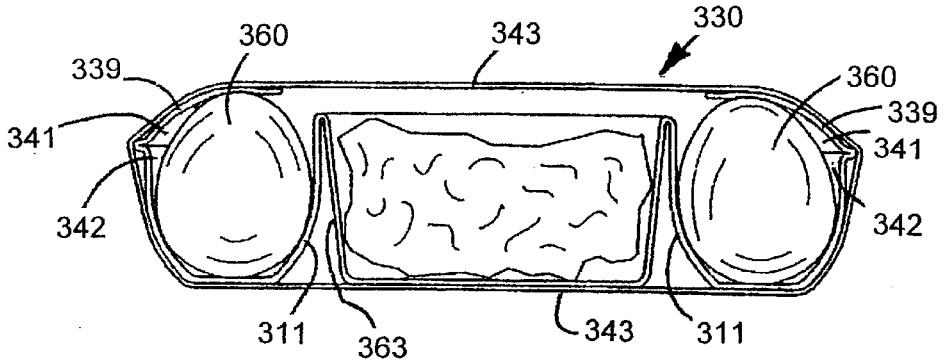
FIG. 23 is an end elevational view of another embodiment of this invention.
Figure 24:
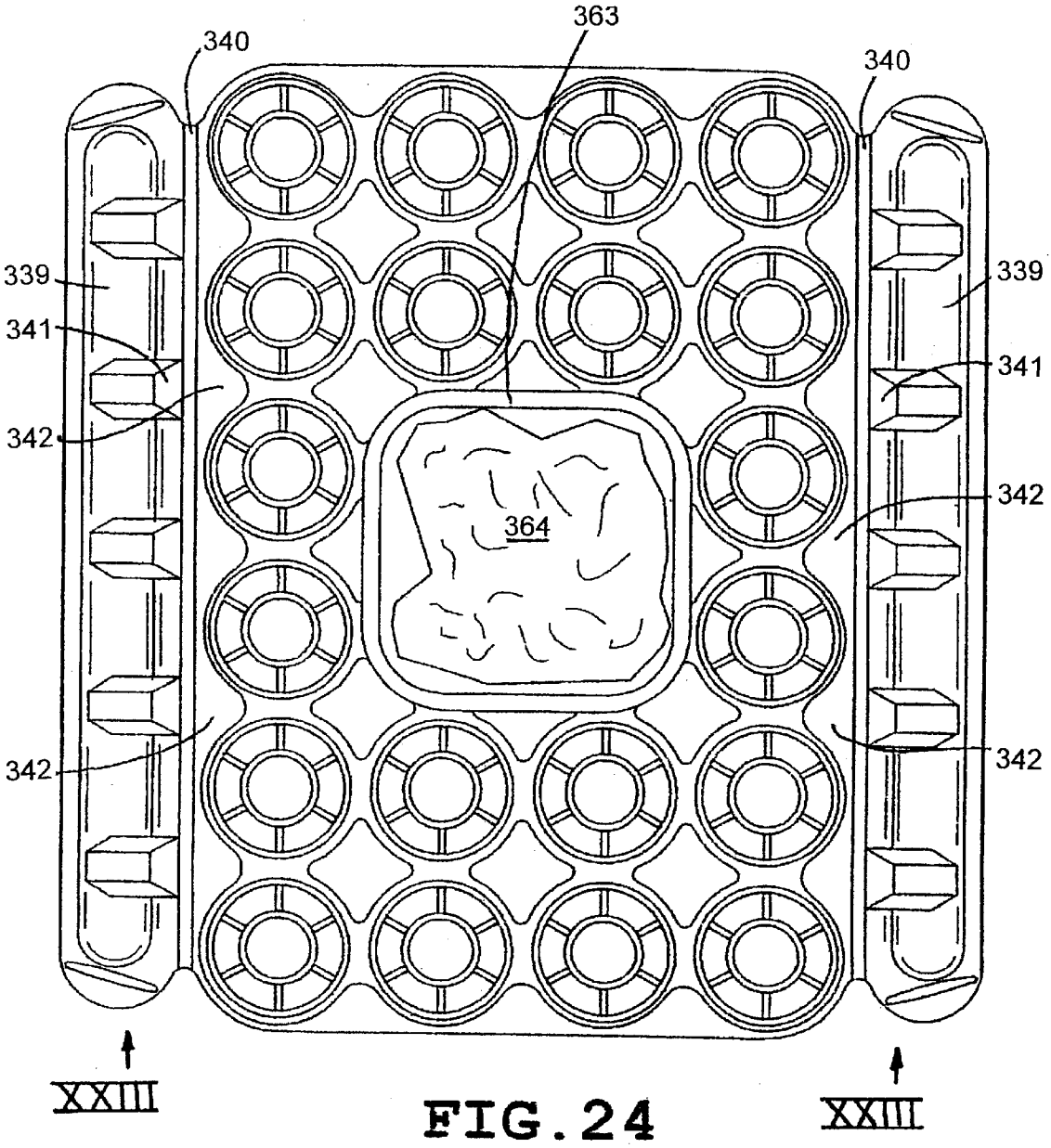
FIG. 24 is a plan view of the embodiment of FIG. 23.

FIGS. 23 and 24 disclose another egg carton package in which normally two dozen eggs are packaged and which has been modified in accordance with the concept of this invention. Carton 330 contains the egg cups 311 containing eggs 360 which extend above the uppermost parts of the egg cups 311. On each side is located flaps 339 each of which are pivoted by a living hinge 340 and are shaped to extend over the eggs along opposite sides of the carton. The flaps 339 each have an inner protrusion 341 which engages a stop 342 to the carton to prevent each flap from pivoting downwardly too far so as to protect the eggs 360 along each side of the package. The entire package is encapsulated by a thin plastic sheet 343 applied by shrink-wrapping or other well-known means. This package as thus far described is old in the art. The uniqueness of carton 330 is the compartment 363 located in the center of the carton and occupying the space of four egg cups normally occupying such space. Compartment 363 contains elements 364 other than eggs. Within broader aspects of this embodiment, the compartment can be located elsewhere within the outer boundary of the carton. Also, more than one compartment each occupying a space greater than one egg cup can be formed in the carton. The integrity of the package is assisted by a plastic sheet 343 encapsulating the carton by shrink-wrapping or other well-known means.

Although the invention has been described with respect to preferred embodiments, it will be apparent that the invention is capable of numerous modifications and variations which may be apparent to those skilled in the art without departing from the spirit and scope of the invention.

The invention claimed is:

1. An egg carton for eggs comprising a bottom having a plurality of bottom egg cups for receiving eggs;

and a top cover;

the improvement comprising:

at least one compartment in said bottom extending along and located adjacent some of said egg cups providing a separate container occupying a space substantially greater than any one of said egg cups for containing elements other than eggs; said compartment formed by a first side wall extending along at least said cups and having a first upper edge and a first lower edge, a second side wall spaced from and extending along said first side wall and having a second upper edge and a second lower edge, a first end wall extending between one of the ends of said first and second side walls and having a third upper edge and a third lower edge, a second end wall extending between the other of the ends of said first and second side walls and having a fourth upper edge and a fourth lower edge, a bottom wall extending between and connected to said first, second, third, and fourth lower edges; said bottom wall, said first side walls, said second side wall and said first and second end walls defining a space therebetween void of any egg cups for receiving and containing elements other than eggs; and said egg cups containing eggs and said compartment containing edible elements other than eggs for use with said eggs in the preparation of an egg dish.

2. The egg carton of claim 1 in which two groups of four bottom egg cups are provided, one group at each end of said carton; and said compartment occupying a space substantially equivalent to a group of four bottom egg cups located between said groups of four bottom egg cups whereby said compartment provides a container having a volume greater than the volume of four cups.

3. The egg carton of claim 1 in which a group of four bottom egg cups are provided and the compartment is located adjacent two of said bottom egg cups and occupies a space substantially equivalent to two adjacent bottom egg cups.

4. An egg carton of claim 1 in which a group of four bottom egg cups arranged in two rows is provided intermediate the ends of said carton, two on each side and adjacent the middle of said carton, and a compartment occupying a space substantially equivalent to a group of at least two bottom egg cups is located between the ends of said carton and said bottom egg cups.

5. The egg carton of claim 4 in which each compartment occupies a space substantially equivalent to four bottom egg cups.

6. The egg carton of claim 4 in which means is provided at the center of the carton between the egg cups to separate the carton into two parts.

7. The egg carton of claim 5 in which means is provided at the center of the carton between the egg cups to separate the carton into two parts.

8. An egg carton of claim 1 in which said eggs are arranged in four rows, each row constituting two eggs, said rows extending between the sides of said carton; and compartments located between two rows.

9. An egg carton of claim 1 in which the compartment is hat-shaped and is located at the center of the carton with three egg cups located at each end of the carton.

10. The egg carton of claim 1 in which the compartment occupies a space of at least six egg cups and is located at the center of the carton with two egg cups located at each end of the carton.

11. The egg carton of claim 1 in which the bottom is sufficiently deep whereby the top edges of said bottom are located on a plane above the top of said eggs.

12. The egg carton of claim 11 in which the cover is a relatively thin plastic sheet.

13. An egg carton of claim 1 in which said bottom has four sides with flaps hinged to two opposite sides; said flaps adapted to extend upwardly and inwardly toward said compartment and shaped to extend over at least portions of said eggs located along and adjacent said sides; and said cover constituting a thin sheet of material securely wrapped around said entire carton with said eggs in place thereby holding said eggs securely within said egg cups.

14. An egg carton for eggs comprising a bottom having a plurality of bottom egg cups for receiving eggs;

and a top cover;

the improvement comprising:

at least one compartment in said bottom extending along and located adjacent some of said egg cups providing a separate container occupying a space substantially greater than any one of said egg cups for containing elements other than eggs; and said compartment formed by a wall structure, a bottom and said top, said compartment defining a space void of any egg cups for receiving and containing elements other than eggs; and said egg cups containing eggs and said compartment containing edible elements other than eggs for use with said eggs in the preparation of an egg dish.

15. The egg carton of claim 14 in which two groups of four bottom egg cups are provided, one group at each end of said carton; and said compartment occupying a space substantially equivalent to a group of four bottom egg cups located between said groups of four bottom egg cups whereby said compartment provides a container having a volume greater than the volume of four cups.

16. The egg carton of claim 14 in which a group of eight bottom egg cups arranged in two rows are provided intermediate the ends of said carton, four on each side of the longitudinal middle of said carton; and two of said compartments being separate from each other and each occupying a space substantially equivalent to a group of two bottom egg cups one compartment located between each end and the middle of said carton.

17. The egg carton of claim 16 in which means is provided at the center of the carton to separate the carton into two parts, each part containing four eggs and one of said compartments.

18. The egg carton of claim 16 in which means is provided at the center of the carton to separate the carton into two parts, each part containing two eggs and one of said compartments.

19. An egg carton of claim 14 in which a group of four bottom egg cups arranged in two rows is provided intermediate the ends of said carton, two on each side and adjacent the middle of said carton, and a compartment occupying a space substantially equivalent to a group of at least two bottom egg cups is located between the ends of said carton and said bottom egg cups.

20. An egg carton of claim 14 in which said eggs are arranged in four rows, each row constituting two eggs, said rows extending between the sides of said carton; and compartments located between two rows.

21. The egg carton of claim 19 in which each compartment occupies a space substantially equivalent to four bottom egg cups.

22. The egg carton of claim 19 in which means is provided at the center of the carton between the egg cups to separate the carton into two parts.

23. The egg carton of claim 21 in which means is provided at the center of the carton between the egg cups to separate the carton into two parts.

24. An egg carton of claim 14 in which the compartment is hat-shaped and is located at the center of the carton with three egg cups located at each end of the carton.

25. The egg carton of claim 14 in which the compartment occupies a space of at least six egg cups and is located at the center of the carton with two egg cups located at each end of the carton.

26. An egg carton for eggs comprising a bottom having a plurality of bottom egg cups for receiving eggs;

a top having a plurality of top egg cups, each top cup vertically aligned with one of said bottom cups whereby said aligned top and bottom egg cups are each to encompass and support an egg;

the improvement comprising:

at least one first compartment in said bottom and at least one second compartment in said top; said first compartment extending along and located adjacent some of said bottom egg cups providing a separate container occupying a space substantially greater than any one of said bottom egg cups for containing elements other than eggs; said second compartment extending along and located adjacent at least some of said top egg cups providing a separate container occupying a space substantially greater than any one of said top egg cup for containing elements other than eggs;

said first compartment formed by a wall structure and a bottom defining a space void of any egg cups;

said second compartment formed by a wall structure and a top defining a space void of any egg cups; said first and second compartments in each of said bottom and top being aligned to provide at least one combined compartment defining a space void of any egg cups for receiving and containing elements other than eggs; and said aligned egg cups contain eggs and said combined compartment contains elements other than eggs for use with said eggs in the preparation of an egg dish.

27. The egg carton of claim 26 in which two groups of four aligned bottom and top egg cups are provided, one group at each end of said carton; and said combined compartment occupying a space substantially equivalent to a group of four aligned bottom and top cups is located between said groups of four aligned bottom and top cups whereby said combined compartment provides a container having a volume greater than the combined volume of four aligned bottom and top cups.

28. The egg carton of claim 26 in which a group of eight aligned bottom and top egg cups arranged in two rows are provided intermediate two combined compartments formed at the ends of said carton; said two combined compartments each occupying a space substantially equivalent to a group of two aligned bottom and top cups whereby each of said combined compartments provides a container having a volume greater than a group of two aligned bottom and top cups.

29. The egg carton of claim 26 in which a group of four aligned bottom and top egg cups are provided and the combined compartment is located adjacent two of said aligned bottom and top egg cups and occupies a space substantially equivalent to two adjacent aligned bottom and top egg cups.

30. The egg carton of claim 26 in which said first compartment includes a first compartment portion and said second compartment includes a second compartment portion, said first compartment portion of said bottom having a first wall extension and said second compartment portion of said top having a second wall extension, said first and second wall extensions having edges engaging each other to isolate said combined compartment from said egg cups.

31. The egg carton of claim 28 in which said first compartment includes a first compartment portion and said second compartment includes a second compartment portion, said first compartment portion of said bottom having a first wall extension and said second compartment portion of said top cover having a second wall extension, said first and second wall extensions having edges engaging each other to isolate said combined compartment from said egg cups.

32. An egg carton for eggs comprising a bottom having a plurality of bottom egg cups for receiving eggs;

and a top cover;

the improvement comprising:

at least one compartment in said bottom extending along and located adjacent some of said egg cups providing a separate container defining a space void of any egg cups and substantially greater than the space defined by any one of said egg cups for containing elements other than eggs; said bottom egg cups having upper ends terminating on a plane and shaped and dimensioned to receive eggs with their upper portions thereof extending above said plane; and said top cover having sides and a top, said sides being dimensioned to provide a cavity for receiving the upper portions of eggs extending above said plane; and said egg cups containing eggs and said compartment containing edible elements other than eggs for use with said eggs in the preparation of an egg dish.

33. An egg carton of claim 32 in which a group of four bottom egg cups arranged in two rows is provided intermediate the ends of said carton, two on each side and adjacent the middle of said carton, and a compartment occupying a space substantially equivalent to a group of at least two bottom egg cups is located between the ends of said carton and said bottom egg cups.

34. The egg carton of claim 33 in which each compartment occupies a space substantially equivalent to four bottom egg cups.

35. The egg carton of claim 33 in which means is provided at the center of the carton between the egg cups to separate the carton into two parts.

36. The egg carton of claim 34 in which means is provided at the center of the carton between the egg cups to separate the carton into two parts.

37. An egg carton of claim 32 in which the compartment is hat-shaped and is located at the center of the carton with three egg cups located at each end of the carton.

38. The egg carton of claim 32 in which the compartment occupies a space of at least six egg cups and is located at the center of the carton with two egg cups located at each end of the carton.

* * * * *